US009359740B2

(12) United States Patent
Yang et al.

(10) Patent No.: US 9,359,740 B2
(45) Date of Patent: Jun. 7, 2016

(54) MESH FOUNDATION CONSTRUCTION METHOD USING HOLLOW BLOCKS

(71) Applicant: ACEALL CO., LTD., Seoul (KR)

(72) Inventors: Tae Chul Yang, Seoul (KR); Kab Boo Kim, Seoul (KR)

(73) Assignee: ACEALL CO., LTD., Seoul (KR)

( * ) Notice: Subject to any disclaimer, the term of this patent is extended or adjusted under 35 U.S.C. 154(b) by 0 days.

(21) Appl. No.: 14/357,766

(22) PCT Filed: Oct. 24, 2012

(86) PCT No.: PCT/KR2012/008765

§ 371 (c)(1),
(2) Date: May 12, 2014

(87) PCT Pub. No.: WO2013/073781

PCT Pub. Date: May 23, 2013

(65) Prior Publication Data

US 2014/0311084 A1 Oct. 23, 2014

(30) Foreign Application Priority Data

Nov. 15, 2011 (KR) ..... 10-2011-0118731

(51) Int. Cl.

| | |
|---|---|
| ***E04G 21/00*** | (2006.01) |
| ***E04G 23/00*** | (2006.01) |
| ***E02D 27/32*** | (2006.01) |

(Continued)

(52) U.S. Cl.

CPC ..... *E02D 27/32* (2013.01); *E02D 27/08* (2013.01); *E02D 27/28* (2013.01)

(58) Field of Classification Search

CPC ..... E04D 27/08; E04D 27/28; E04D 27/32; E04D 27/00; E04D 27/01; E04D 27/02; E04D 27/016; E04C 1/395; E04B 2/14; E04B 2/42

USPC ..... 52/741.15, 302.4, 570, 293.2, 379, 503, 52/504, 608, 606

See application file for complete search history.

(56) References Cited

U.S. PATENT DOCUMENTS 1,542,001 A * 6/1925 Pilati ..... 52/591.1
3,848,377 A * 11/1974 Mori ..... 52/169.1

(Continued)

FOREIGN PATENT DOCUMENTS

JP H11-107293 A 4/1999
JP 4047660 B2 2/2008

(Continued)

OTHER PUBLICATIONS

International Search Report for PCT/KR2012/008765.

*Primary Examiner* — Brian Mattei
(74) *Attorney, Agent, or Firm* — Sughrue Mion, PLLC

(57) ABSTRACT

A mesh foundation construction method using hollow blocks is disclosed. The method may include: leveling an upper part of a ground selected for reinforcing; arranging a multiple number of hollow blocks adjacent to one another in a mesh form such that one side touches the upper part of the ground, where a hollow block includes an enclosed sidewall that defines a hollow part, which penetrates from said one side to the other side; and filling the hollow parts with a filler, which includes one or more of gravel and sandy soil. With this method, a ground that does not provide a supporting force sufficient to hold an upper structure can be reinforced to support an upper structure without forming a deep foundation, such as piles, etc.

13 Claims, 7 Drawing Sheets

(51) Int. Cl. *E02D 27/08* (2006.01)
*E02D 27/28* (2006.01)

(56) References Cited

U.S. PATENT DOCUMENTS 4,172,680 A * 10/1979 Brown ..... 405/16
6,579,038 B1 * 6/2003 McAllister et al. ..... 405/16
2004/0000114 A1 * 1/2004 Schools et al. ..... 52/505
2011/0086189 A1 * 4/2011 Bigger ..... 428/33

FOREIGN PATENT DOCUMENTS

KR 20-0372773 Y1 1/2005
KR 10-0853125 B1 8/2008

* cited by examiner (a) (b)

(a) (b)

Graph representing subsidence according to applied load (a) (b)

MESH FOUNDATION CONSTRUCTION METHOD USING HOLLOW BLOCKS

CROSS REFERENCE TO RELATED APPLICATIONS AND CLAIM OF PRIORITY

This patent application claims benefit under 35 U.S.C. 119(e), 120, 121, or 365(c), and is a National Stage entry from International Application No. PCT/KR2012/008765, filed 24 Oct. 2012, which claims priority to Korean Patent Application No. 10-2011-0118731, filed Nov. 15, 2011, entire contents of which are incorporated herein by reference.

TECHNICAL FIELD

The present invention relates to a mesh foundation construction method using hollow blocks. More particularly, the invention relates to a mesh foundation construction method using hollow blocks with which a ground that does not provide a supporting force sufficient to hold an upper structure can be reinforced to support an upper structure without forming a deep foundation, such as piles, etc.

BACKGROUND ART

When constructing a structure such as a building over a ground surface, a foundation may be formed to transfer the weight of the structure, and loads applied on the structure, to the ground in a stable manner, as well as to prevent intolerable levels of defects such as subsidence, inclination, movement, deformation, vibration, etc.

The types of a foundation can be divided largely into a direct foundation (or shallow foundation), which may be applied when the ground is capable of sufficiently supporting the loads of a structure, and which may involve directly transferring the loads from the foundation slab to the ground, and a deep foundation, which may be applied when the ground does not provide a sufficient supporting force or when there is a risk of excessive subsidence, and which may involve transferring the loads of the structure to deeper ground levels by using piles, piers, caissons, etc.

Also known in the art is the top-base foundation (also called the "top-pile foundation"), used on a ground that does not provide a sufficient supporting force, where the ground is reinforced with concrete blocks having the shape of a top and filler gravel, and a direct foundation is formed on the reinforced ground without forming support piles.

FIG. 1 illustrates a top-base foundation according to the related art. Looking at a method of forming a top-base foundation according to the related art with reference to FIG. 1, a positioning frame 60 may be formed by welding rebars to form square grids having equal intervals along the lateral and longitudinal directions over the ground that is to be reinforced and form a triangular grid in a corner of each square grid, and top-shaped concrete piles 10*b* may be arranged in equal intervals along the lateral and longitudinal directions by forcing the top-shaped concrete piles 10*b* into the ground with the pile portions 54 inserted through the respective triangular grids. Then, connector rebars 64 placed along the lateral and longitudinal directions may be welded to connector rings 56 that are exposed at the upper surfaces of the top-shaped main portions 52, so that all of the top-shaped concrete files 10*b* may be connected and secured to one another. Then, the spaces between the ground surface and the bottom parts of the top-shaped main portions 52 of the top-shaped concrete files 10*b* may be filled with gravel while using a vibration device for compacting the gravel, and the gravel remaining on the upper surfaces of the top-shaped main portions 52 may be removed clean to complete the foundation construction using top-shaped concrete files.

Applying a deep foundation according to the related art on a ground that does not provide a sufficient supporting force may entail the problem of increased costs, as piles, piers, etc., have to be placed up to the deeper ground levels.

Also, the top-base foundation described above may involve a complicated process, due to the critical processes of installing the top-shaped concrete blocks, welding the connector rebars, compacting the filler gravel, and the like, and may hence entail increased construction costs.

SUMMARY

The present invention provides a mesh foundation construction method using hollow blocks with which a ground that does not provide a supporting force sufficient to hold an upper structure can be reinforced to support an upper structure without forming a deep foundation, such as piles, etc.

Also, the invention provides a mesh foundation construction method using hollow blocks which can reinforce a ground by using hollow blocks having a simplified shape to induce an increase in the supporting force and a reduction in the amount of subsidence.

An aspect of the present invention provides a method of constructing a mesh foundation using hollow blocks that includes: leveling an upper part of a ground selected for reinforcing; arranging a multiple number of hollow blocks adjacent to one another in a mesh form such that one side touches the upper part of the ground, where a hollow block includes an enclosed sidewall that defines a hollow part, which penetrates from said one side to the other side; and filling the hollow parts with a filler, which includes one or more of gravel and sandy soil.

The method can further include, after the filling: forming a concrete foundation by casting unhardened concrete over the hollow blocks filled with the filler and curing the concrete.

The method can further include, before the forming of the concrete foundation: covering an upper part of the hollow blocks to prevent moisture of the unhardened concrete from entering the hollow parts of the hollow blocks.

The leveling operation can include flattening an upper surface by spreading and compacting a base material that includes one or more of gravel and sandy soil.

The base material can be formed to a depth greater than ½ of a length of the longest possible line segment connecting two points on an outer perimeter of the horizontal cross section of the hollow block.

The hollow block can be formed such that a cross section formed by the sidewall is shaped as a circle.

In the arranging operation, a multiple number of the hollow blocks can be arranged in a mesh form with a particular distance in-between, with the distance being smaller than or equal to a thickness of the sidewall.

In the arranging operation, a multiple number of the hollow blocks can be arranged such that the outer perimeters of the sidewalls touch one another.

A multiple number of hollow blocks can be integrated as a unit block set.

The hollow block can be formed such that a cross section formed by the sidewall is shaped as a regular hexagon, and multiple hollow blocks can share the sidewall to be integrated as a unit block set having a honeycomb shape.

The proportion of a distance D2 between intersection points of an imaginary line segment passing through a center of a horizontal cross section of the hollow block and an outer perimeter of the horizontal cross section to a distance D1 between intersection points of an imaginary line segment passing through a center of a horizontal cross section of the hollow block and an inner perimeter of the horizontal cross section can be from 0.32 to 0.98.

The proportion of the distance D2 between intersection points between an imaginary line segment passing through a center of a horizontal cross section of the hollow block and an outer perimeter of the horizontal cross section to a height H of the hollow block can be from 0.15 to 1.1.

After the filling with the filler, the method can include repeatedly performing the operations of: flattening an upper surface by again spreading and compacting a base material including one or more of gravel and sandy soil over the hollow blocks filled with the filler; arranging the hollow blocks adjacent to one another in a mesh form again over the flattened base material; and filling the hollow parts and spaces formed by the hollow blocks with a filler including one or more of gravel and sandy soil.

According to certain embodiments of the present invention, a ground that does not provide a supporting force sufficient to hold an upper structure can be reinforced to support an upper structure without forming a deep foundation, such as piles, etc.

Also, a ground can be reinforced by using hollow blocks having a simplified shape to induce an increase in the supporting force and a reduction in the amount of subsidence.

DETAILED DESCRIPTION—

Figure 1:
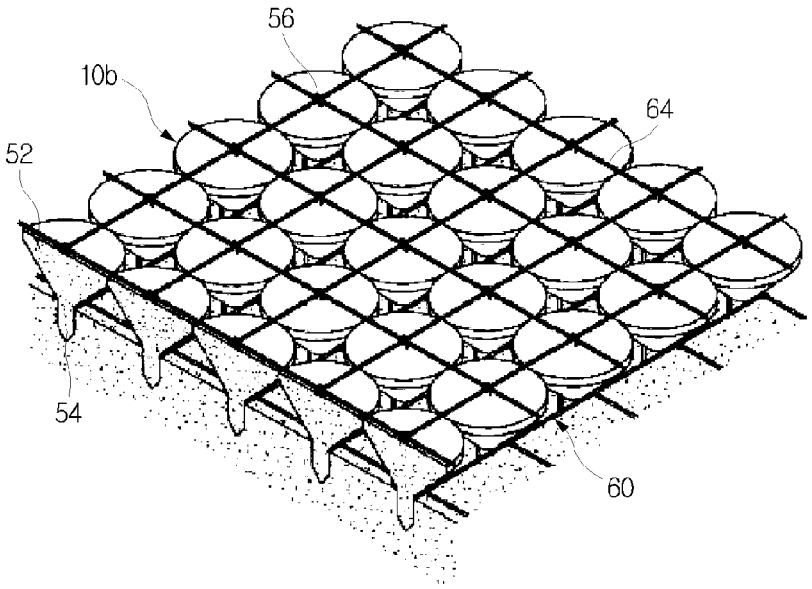
FIG. 1 PRIOR ART
FIG. 1 illustrates a top-base foundation according to the related art.

As the present invention allows for various changes and numerous embodiments, particular embodiments will be illustrated in the drawings and described in detail in the written description. However, this is not intended to limit the present invention to particular modes of practice, and it is to be appreciated that all changes, equivalents, and substitutes that do not depart from the spirit and technical scope of the present invention are encompassed in the present invention. In the description of the present invention, certain detailed explanations of the related art are omitted when it is deemed that they may unnecessarily obscure the essence of the present invention. Certain embodiments of the present invention will be described below in detail with reference to the accompanying drawings.

A mesh foundation construction method according to certain embodiments of the present invention will be described below in more detail. In describing the appended drawings, identical or corresponding elements will be represented by the same reference numerals, and redundant descriptions will be omitted.

Figure 2:
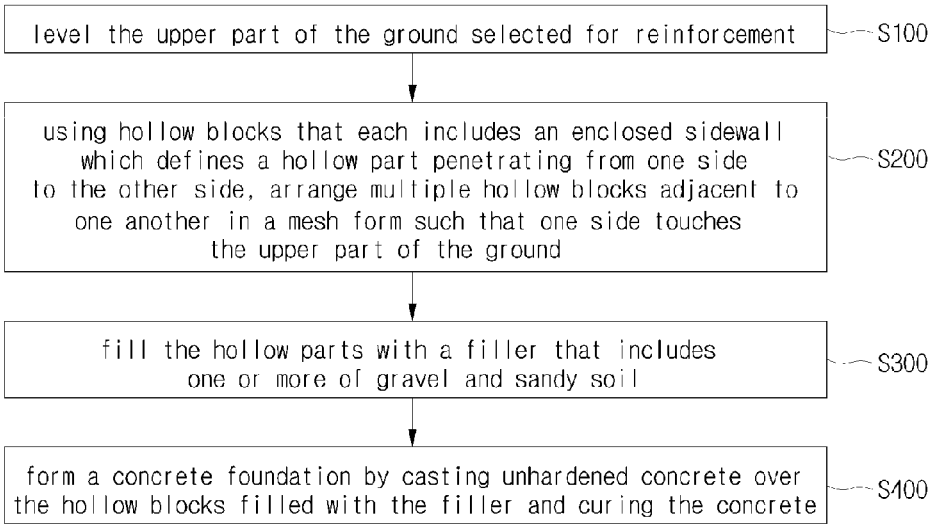
FIG. 2 is a flowchart of a mesh foundation construction method using hollow blocks according to an embodiment of the present invention.

FIG. 2 is a flowchart of a mesh foundation construction method using hollow blocks according to an embodiment of the present invention, and FIG. 3 to FIG. 7 represent the flow of a mesh foundation construction method using hollow blocks according to an embodiment of the present invention. Illustrated in FIG. 3 to FIG. 7 are the ground 12, a base material 14, hollow blocks 16, sidewalls 18, hollow parts 20, a filler 22, a cover 24, and a concrete foundation 26.

A mesh foundation construction method using hollow blocks according to this embodiment may include the operations of leveling an upper part of the ground 12 selected for reinforcing; arranging the hollow blocks 16 adjacent to one another in a mesh form such that one side touches the upper part of the ground 12, where a hollow block 16 includes an enclosed sidewall 18 that defines a hollow part 20 which penetrates from said one side to the other side; and filling the hollow parts 20 with a filler 22 that includes one or more of gravel and sandy soil. Thus, a ground 12 that otherwise does not provide a supporting force sufficient to hold an upper structure can be reinforced to support an upper structure, without having to form a deep foundation such as piles, etc., in the ground 12.

Figure 3:
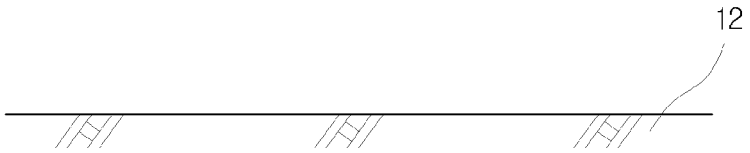
FIG. 3 to FIG. 7 represent the flow of a mesh foundation construction method using hollow blocks according to an embodiment of the present invention.
Figure 4:
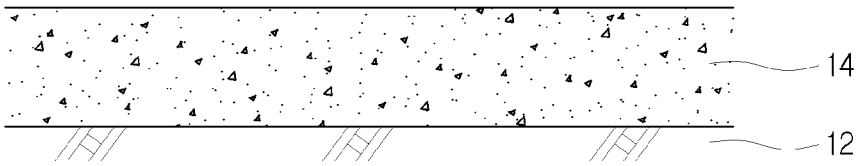

Considering a mesh foundation construction method using hollow blocks according to the present embodiment, the upper part of the ground 12 for which reinforcement is desired may first be leveled (S100), as illustrated in FIG. 3 and FIG. 4. The ground 12, with which there is a risk of subsidence of the upper structure and an insufficient supporting force, may be leveled to be flat and even. In this operation, a base material 14 that includes one or more of gravel and sandy soil may be spread and compacted over the ground to flatten the upper surface.

In the case of sandy soil ground where the ground 12 has adequate strength, the leveling work can be performed on the original ground 12, and in the case of weak ground 12 or cohesive soil ground 12 where the ground 12 has low strength, the upper surface can be flattened by leveling the upper part of the ground 12 to be flat and even, and afterwards spreading and compacting a base material 14 including one or more of gravel and sandy soil over the leveled ground 12.

According to the load of the upper structure that is to be constructed, the original ground 12 can be leveled, or the base material 14 can be spread and compacted over the leveled ground 12 to improve the upper part of the ground 12 to a more adequate ground 12.

The base material 14 can include gravel having good particle size distribution with particles of various sizes distributed evenly, sandy soil which provides adequate ground strength, or a mixture of gravel and sandy soil. The selection of the base material 14 can be determined according to the load of the upper structure that is to be constructed.

An upper structure refers to a structure such as a building, bridge pillar, culvert, drainage conduit, underground parking lot, retaining wall, etc., that is constructed or placed over a foundation reinforced according to the present embodiment.

Figure 5:
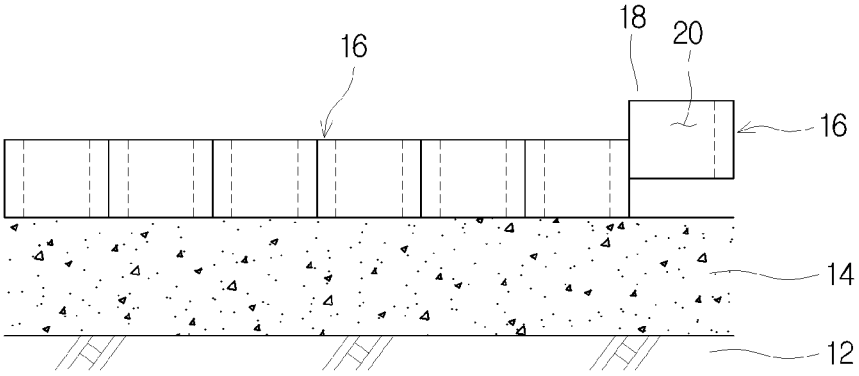

Then, the hollow blocks 16, each of which has an enclosed sidewall 18 that defines a hollow part 20 penetrating from one side to the other side, may be arranged adjacent to one another in a mesh form such that one side of the hollow blocks touch the upper part of the ground 12 (S200), as illustrated in FIG. 5.

The hollow block 16 may be a tube-shaped block having an enclosed sidewall 18 that defines the hollow part 20, which forms a penetration along the up/down direction, and the hollow blocks 16 may be arranged adjacent to one another in a mesh form such that one side of the hollow block 16 touches the top of the leveled ground 12. The multiple hollow blocks 16 can be arranged separated from one another by a particular distance or can be arranged such that their outer perimeters are in contact.

Figure 8:
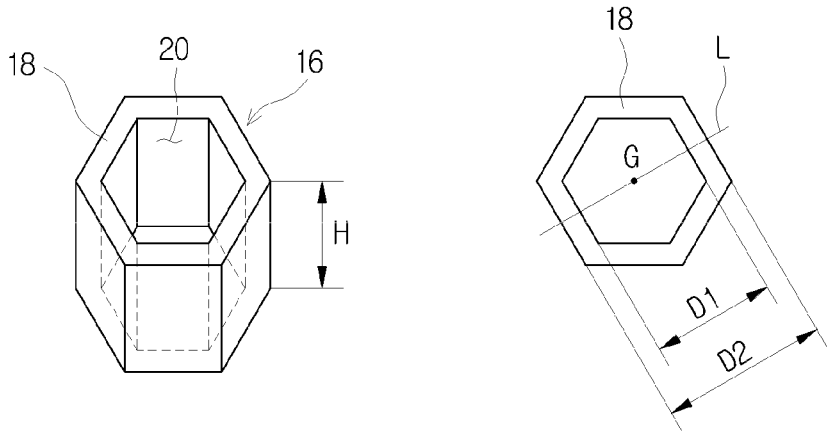
FIG. 8 shows a hollow block used in a mesh foundation construction method using hollow blocks according to an embodiment of the present invention.
Figure 9:
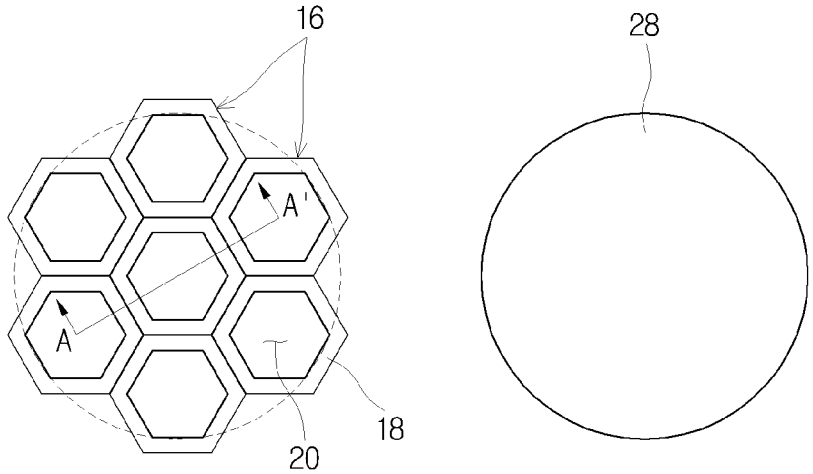
FIG. 9 illustrates a method of testing a hollow block used for a mesh foundation construction method using hollow blocks according to an embodiment of the present invention.

In this embodiment, a hollow block 16 may be used, of which the cross section formed by the sidewall 18 is shaped as a regular hexagon, as illustrated in FIG. 8, and the hexagonal hollow blocks 16 may be arranged in a mesh form of a honeycomb shape with one sidewall 18 touching another (see drawing (a) of FIG. 9).

Figure 6:
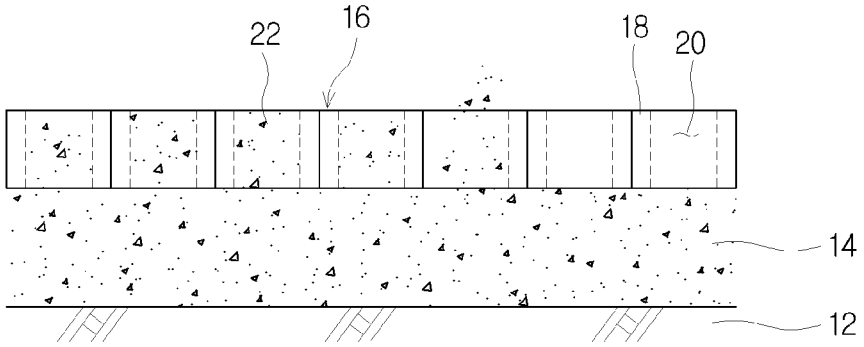

Then, the hollow parts 20 may be filled with a filler 22 that includes one or more of gravel and sandy soil (S300), as illustrated in FIG. 6. When multiple hollow blocks 16 are arranged adjacent to or in contact with one another in a mesh form over the leveled ground 12, there can be spaces formed between the hollow blocks 16, and in such cases, the filler 22 including one or more of gravel and sandy soil can be filled into these spaces as well as the hollow part 20.

Similar to the base material 14, the filler 22 can include gravel having good particle size distribution with particles of various sizes distributed evenly, sandy soil which provides adequate ground strength, or a mixture of gravel and sandy soil. The selection of the filler 22 can be determined according to the load of the upper structure that is to be constructed, as in the case of selecting the base material 14. During the filling operation, compaction can be applied so that the filler 22 may be filled well in the hollow parts 20 and in spaces formed by the multiple hollow blocks 16.

In this embodiment, the multiple hexagonal hollow blocks 16 may be arranged in a mesh form with one sidewall 18 touching another in the shape of a honeycomb so that there may be no space formed between the hollow blocks 16. Thus, the filler 22 may be filled only in the hollow parts 20 of the hollow blocks 16.

Figure 7:
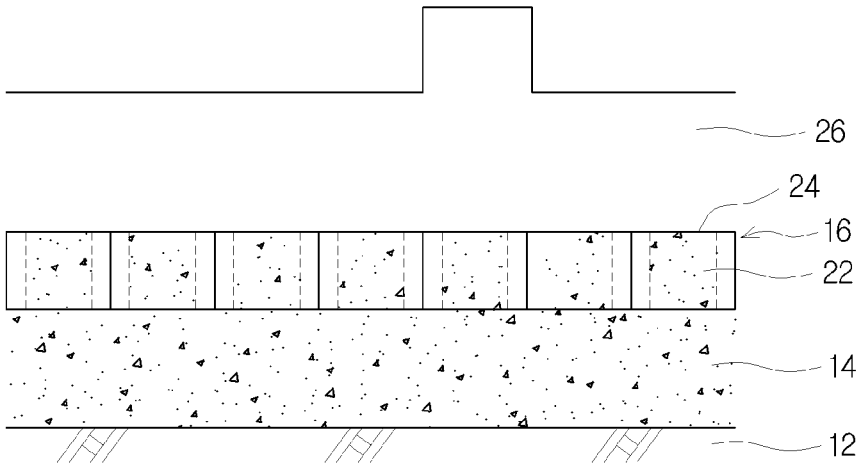

Then, a concrete foundation 26 may be formed by casting unhardened concrete over the hollow blocks 16 filled with the filler 22 and curing the concrete (S400), as illustrated in FIG. 7. Once a lower foundation is formed by the operations described above, a concrete foundation 26 may be formed according to the type of upper structure, by casting the unhardened concrete over the hollow blocks 16 filled with the filler 22 and curing the concrete. For example, if the upper structure is a building, then a concrete foundation 26 may be formed by casting and curing concrete, and the building may be constructed over the concrete foundation 26.

In cases where the upper structure is a culvert or a box structure, it may also be possible to place the upper structure directly over the hollow blocks 16 filled with the filler 22, without forming the concrete foundation 26.

During the process of casting unhardened concrete and curing the concrete to form the concrete foundation 26, the moisture from the unhardened concrete can seep into the hollow parts 20 to alter the properties of the filler 22 and the base material 14, and thus in order to prevent this, a cover 24, etc., can be used to cover an upper part of the hollow blocks 16.

Figure 10:
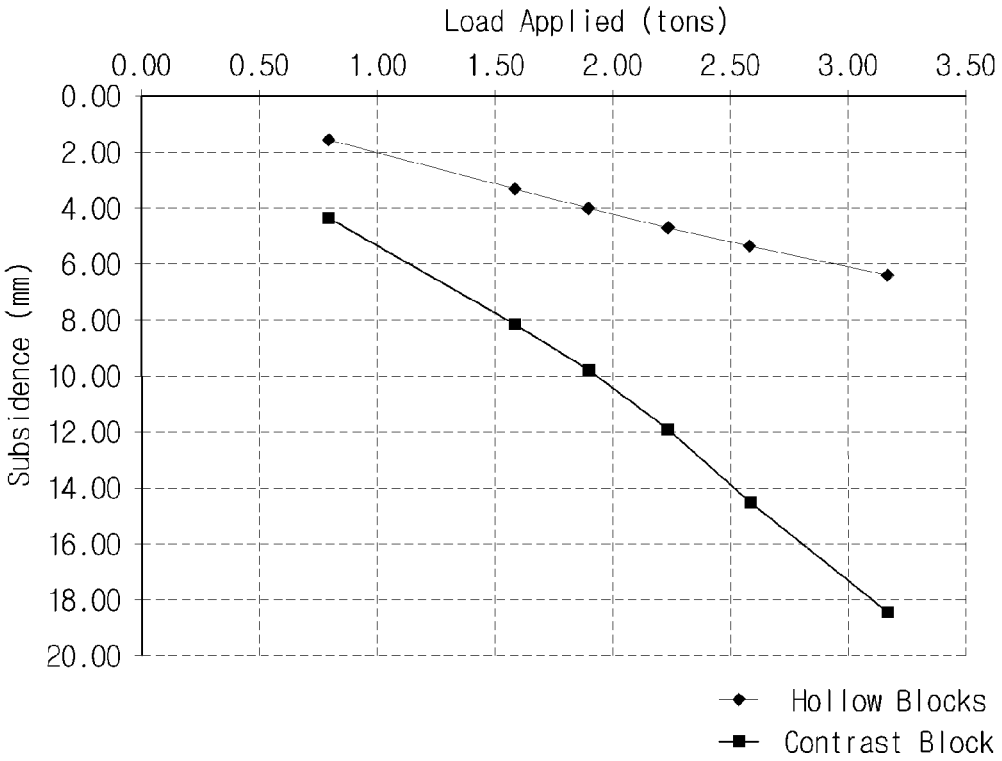
FIG. 10 is a graph representing test results for a hollow block used for a mesh foundation construction method using hollow blocks according to an embodiment of the present invention.
Figure 11:
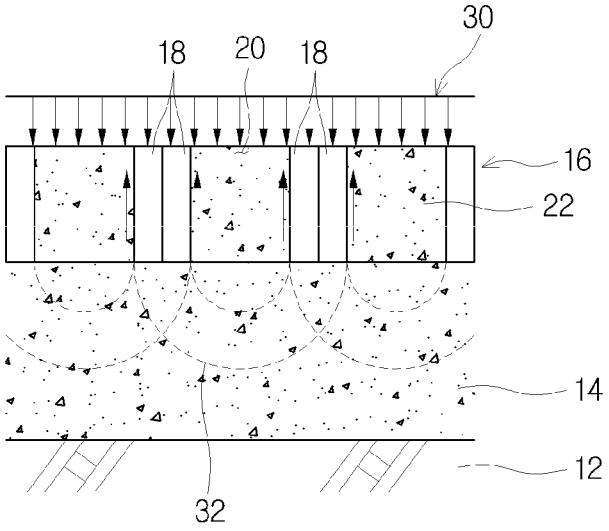
FIG. 11 illustrates the arching effect provided by a mesh foundation construction method using hollow blocks according to an embodiment of the present invention.

FIG. 8 shows a hollow block used in a mesh foundation construction method using hollow blocks according to an embodiment of the present invention. FIG. 9 illustrates a method of testing a hollow block used for a mesh foundation construction method using hollow blocks according to an embodiment of the present invention, and FIG. 10 is a graph representing test results for a hollow block used for a mesh foundation construction method using hollow blocks according to an embodiment of the present invention. FIG. 11 illustrates the arching effect provided by a mesh foundation construction method using hollow blocks according to an embodiment of the present invention. Illustrated in FIG. 8, FIG. 9, and FIG. 11 are the ground 12, a base material 14, hollow blocks 16, sidewalls 18, hollow parts 20, a filler 22, a contrast block 28, a surcharge load 30, and arching regions 32.

The following will consider the behavior of the ground 12 beneath the hollow blocks 16 when a surcharge load 30 is applied over the hollow blocks 16, for the case of multiple hollow blocks 16 that are arranged adjacently in a mesh form over the leveled ground 12 with the hollow parts 20 of the hollow blocks 16 filled in with a filler 22.

In order to measure the increase in the supporting force and the reduction in subsidence resulting from the hollow parts 20 of the hollow blocks 16, a comparative test was performed by fabricating a circular contrast block 28 having the same area as the area formed by the outlines of the hollow blocks 16, applying surcharge loads 30 in a stepwise manner, and measuring the amount of subsidence.

That is, a test setup was prepared by forming in a soil tank a base material 14 of gravel having good particle size distribution with particles of various sizes distributed evenly, arranging seven hexagonal hollow blocks 16 in a mesh form shaped as a honeycomb such that one sidewall 18 touches another as illustrated in drawing (a) of FIG. 9, and filling the hollow parts 20 of the hollow blocks 16 with gravel having good particle size distribution with particles of various sizes distributed evenly, after which surcharge loads 30 of equal, uniform distribution were applied in a stepwise manner over the entire area formed by the outlines of the hollow blocks 16 while measuring the amount of subsidence. Then, a contrast setup was prepared in another soil tank with the same conditions as those of the test setup, by forming a base material 14 and installing thereon a contrast block 28 of a circular shape as illustrated in drawing (b) of FIG. 9 that has the same area as the area formed by the outlines of the seven hollow blocks 16 (the region shown in dotted lines that has the same area as the area formed by thick lines in drawing (a) of FIG. 9), after which surcharge loads 30 of equal, uniform distribution were applied in a stepwise manner over the entire area formed by the contrast block 28 while measuring the amount of subsidence.

FIG. 10 shows the amounts of subsidence when the same surcharge loads were applied in a stepwise manner over the hollow blocks 16 and the contrast block 28. That is, the hollow-block line marked by rhombuses (◇) represents the amount of subsidence according to applied load for the hollow blocks 16, while the contrast-block line marked by squares (□) represents the amount of subsidence according to applied load for the contrast block 28.

Referring to FIG. 10, it can be seen that the amount of subsidence of the hollow blocks 16 for each step of applied load is roughly three times as small as the amount of subsidence of the contrast block 28. Thus, since the amounts of subsidence for the hollow blocks 16 are shown to be smaller than the amounts of subsidence for the contrast block 28, it can be determined that the hollow blocks 16 generally increase the supporting force. As the graph shows about a threefold difference in the amounts of subsidence, it can be seen that the supporting force of the hollow block 16 is increased three times as much as the supporting force of the contrast block 28.

The results of decreased subsidence and increased supporting force provided by the hollow blocks 16 compared to the contrast block 28, as indicated above, may be due to an arching phenomenon occurring in the soil beneath the hollow blocks.

FIG. 11 is a cross-sectional view across line A-A' in drawing (a) of FIG. 9, and when a surcharge load 30 is applied on the test setup, the soil pressure beneath the opposing sidewalls 18 of a hollow block 16 may be redistributed in an arch form to form an arching region 32, as illustrated in FIG. 11, due to the arching phenomenon.

When a portion of the ground 12 is made to deform, a shear resistance may be created at the interface between the portion being deformed and the stable portions of the ground 12. Since the shear resistance hinders the deformation of the portion where a break is to occur, the soil pressure may be decreased at the portion being broken, while the soil pressure may be increased at the adjacent portions. The phenomenon of pressure transfer, whereby the soil pressure of the portion where a break is to occur is transferred to the soil of adjacent portions, is referred to as an arching phenomenon.

The arching phenomenon is more pronounced in sand compared to silt or clay, and is more pronounced in dense sand compared to loose sand. For example, when a small hole is bored into soil that is not viscous, such as sand, the upper part remains stable in the shape of an arch.

Thus, when a surcharge load 30 is applied to the test setup, a redistribution of soil pressure may occur in an arch form for the two points beneath a sidewall 18 and the other opposing sidewall 18 of a hollow block 16, so that the soil pressure may be increased, and the surcharge load 30 can be supported with a smaller supporting force. Also, a friction resistance may be created between the sidewalls 18 of the hollow part 20 and the filler which, together with the increase in soil pressure caused by the arching phenomenon, can reduce the transfer of the surcharge load 30 to the ground 12.

The redistribution of soil pressure due to the arching phenomenon may increase the elastic coefficient of the soil below the hollow blocks 16, and such increase in elastic coefficient and increase in supporting force may suppress the subsidence of the hollow blocks 16.

As the arching phenomenon is more pronounced in dense sand and gravel, it may be advantageous to use gravel having good particle size distribution with particles of various sizes distributed evenly, sandy soil which provides adequate strength of the ground 12, or a mixture of gravel and sandy soil, as the base material 14 and filler 22.

In this embodiment, hollow blocks 16 that are shaped as regular hexagons may be arranged in a mesh form such that one sidewall 18 of the hollow block 16 touches another, so that the two sidewalls 18 touching each other may form one support point for an arch.

In cases where the multiple hollow blocks 16 are arranged in a mesh form with a particular distance in-between, the distance can be made smaller than or equal to the thickness of the sidewall 18. This is because the regions beneath two adjacent sidewalls 18 and the region between the portions beneath the two sidewalls 18 can form one support point of an arch if the distance between the two adjacent sidewalls 18 are smaller than or equal to the thickness of a sidewall 18.

FIG. 8 illustrates a hollow block 16 used in a mesh foundation construction method using hollow blocks according to an embodiment of the present invention, where drawing (a) of FIG. 8 shows a perspective view of the hollow block 16, and drawing (b) of FIG. 8 shows a horizontal cross section of the hollow block 16. The drawings illustrate a hollow block 16 in which an enclosed sidewall 18 defines a hollow part 20 that penetrates from one side to the other side, and in which the cross section formed by this sidewall 18 has the form of a regular hexagon.

The arching effect that occurs beneath the hollow block 16 may be affected by the distance between the opposing sidewalls 18, the thickness of the sidewall 18, and the height (H) of the hollow block 16.

According to research performed by the inventors, a significant increase in supporting force and decrease in subsidence caused by the arching effect were observed when the proportion of the distance D2 between the intersection points of an imaginary line segment (L) that passes through the center (G) of a horizontal cross section of the hollow block 16 and the outer perimeter of the horizontal cross section to the distance D1 between the intersection points of an imaginary line segment (L) that passes through the center (G) of the horizontal cross section of the hollow block and the inner perimeter of the horizontal cross section is from 0.32 to 0.98.

Also, a significant increase in supporting force and decrease in subsidence caused by the arching effect were observed when the proportion of the distance D2 between the intersection points of the line segment (L) passing through the center (G) of the horizontal cross section of the hollow block 16 and the outer perimeter of the horizontal cross section to the height H of the hollow block 16 is 1.1.

Since the sidewall 18 of the hollow block 16 becomes a support point of an arch, it may be needed for the hollow block 16 to have a certain level of strength. Thus, the hollow block 16 can be fabricated from concrete, steel, high-strength plastic, etc.

Although this embodiment presents a hollow block 16 of which the cross section formed by the sidewall 18 has the shape of a regular hexagon, other polygonal or circular shapes in which an enclosed sidewall 18 defines a hollow part 20 that penetrates from one side to the other side such that the arching effect is achieved are also possible for the hollow block 16. That is, the hollow block 16 can be used with various shapes, such as a triangle, quadrilateral, pentagon, circle, oval, etc., for the shape of the cross section formed by the enclosed sidewall 18.

When forming the base material 14 on the upper part of the ground 12, the thickness of the base material 14 may be formed greater than ½ of the length of the longest line segment from among the possible line segments connecting two arbitrary points on the outer perimeter of the horizontal cross section of the hollow block 16, in order that a semicircular arch can be formed with a sidewall 18 and its opposing sidewall 18 of the hollow block 16 serving as the support points. For example, in the case of a hollow block 16 shaped as a regular hexagon as in the present embodiment, the thickness of the base material 14 can be made greater than ½ of the distance between two opposing vertices, and in the case of a circular hollow block 16, the thickness of the base material 14 can be made greater than ½ of the outer diameter of the circular hollow block 16. Also, in the case of a polygonal hollow block 16, the base material 14 can be made to a depth greater than ½ of the longest side of the outer perimeter of the polygonal hollow block 16.

Figure 12:
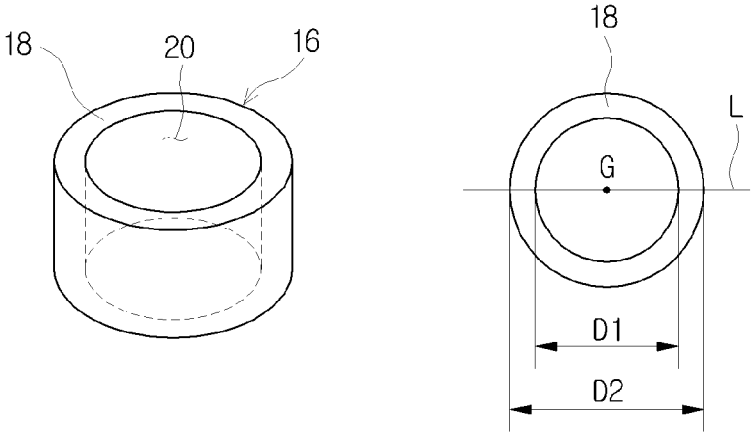
FIG. 12 shows a variation of a hollow block used in a mesh foundation construction method using hollow blocks according to an embodiment of the present invention.
Figure 13:
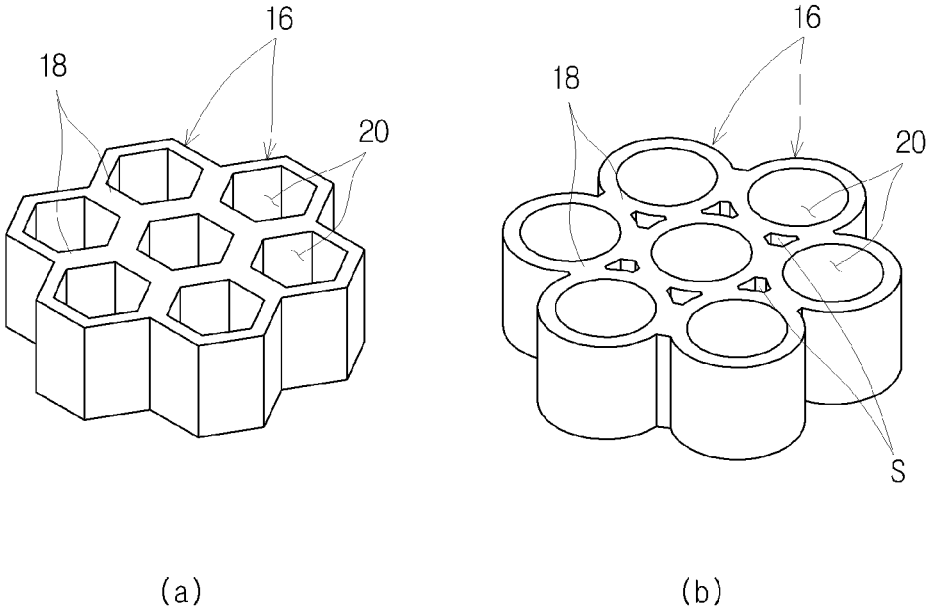
FIG. 13 shows another variation of a hollow block used in a mesh foundation construction method using hollow blocks according to an embodiment of the present invention.

FIG. 12 shows a variation of a hollow block used in a mesh foundation construction method using hollow blocks according to an embodiment of the present invention, and FIG. 13 shows another variation of a hollow block used in a mesh foundation construction method using hollow blocks according to an embodiment of the present invention. Illustrated in FIG. 12 and FIG. 13 are hollow blocks 16, sidewalls 18, and hollow parts 20.

FIG. 12 illustrates a hollow block 16 of which the shape of the cross section formed by the sidewall 18 is circular. The aspect ratios for the hollow block 16 can be represented as the proportions of the outer diameter D2 of the circular hollow block 16 to the inner diameter D1 and the height H. A significant increase in supporting force and decrease in subsidence can be observed when the proportion of the outer diameter D2 to the inner diameter D1 is from 0.32 to 0.98, and when the proportion of the outer diameter D2 to the height H is from 0.15 to 1.1.

To facilitate the fabrication and placement of the hollow blocks 16, it is possible to integrate a multiple number of hollow blocks 16 into a unit block set.

Drawing (a) of FIG. 13 shows a unit block set fabricated by integrating several hexagonal hollow blocks 16 into a single body, where hollow blocks 16 that are in contact with each other may share a sidewall 18, and a unit block set is implemented that has the shape of a honeycomb. Unit block sets such as this can be arranged in contact with one another to facilitate construction.

Drawing (b) of FIG. 13 shows a unit block set fabricated by integrating several circular hollow blocks 16 into a single body, where the spaces (S) formed by adjacent hollow blocks 16 can be left empty, as in drawing (b) of FIG. 13. In this case, the filler 22 can be filled into the hollow parts 20 and the spaces (S) formed by adjacent hollow blocks 16. It is also possible to implement a unit block set with the spaces formed by adjacent hollow blocks 16 filled in.

Figure 14:
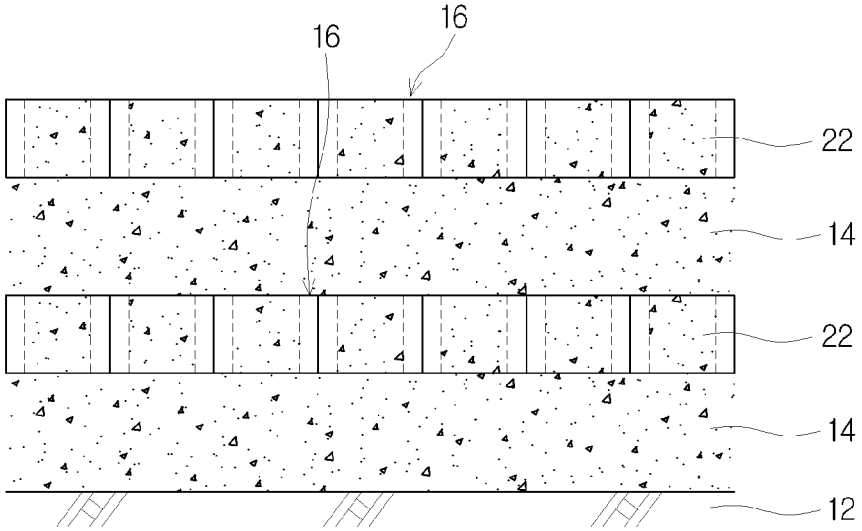
FIG. 14 illustrates a variation of a mesh foundation construction method using hollow blocks according to an embodiment of the present invention.

FIG. 14 illustrates a variation of a mesh foundation construction method using hollow blocks according to an embodiment of the present invention. Illustrated in FIG. 14 are the ground 12, a base material 14, hollow blocks 16, sidewalls 18, hollow parts 20, and a filler 22.

This variation may involve implementing multiple layers of the lower foundation according to an embodiment of the invention described above, when the load caused by the upper structure is large or when the ground 12 is very soft.

That is, after the operation of filling the filler 22 according to an embodiment of the invention described above, the base material 14 including one or more of gravel and sandy soil may again be spread and compacted over the hollow blocks 16 filled with the filler 22, to flatten the upper surface. Then, the operations of arranging the hollow blocks 16 again adjacent to one another in a mesh form over the flattened base material 14 and filling the hollow parts 20 and spaces formed by multiple hollow blocks 16 with a filler 22 that includes one or more of gravel and sandy soil can be performed repeatedly, to implement the lower foundation according to an embodiment of the invention in multiple layers.

While the spirit of the present invention has been described in detail with reference to particular embodiments, the embodiments are for illustrative purposes only and do not limit the invention. It is to be appreciated that those skilled in the art can change or modify the embodiments without departing from the scope and spirit of the invention.

Many embodiments other than those set forth above can be found in the appended claims.

The invention claimed is:

1. A method of constructing a mesh foundation using hollow blocks, the method comprising:

leveling an upper part of a ground selected for reinforcing;

arranging a plurality of hollow blocks adjacent to and in contact with one another in a mesh form in no more than a single layer such that one side touches the upper part of the ground, the hollow block comprising an enclosed sidewall defining a hollow part, the hollow part penetrating from said one side to the other side; and filling the hollow parts with a filler, the filler comprising at least one of gravel and sandy soil, wherein a proportion of a distance D2 between intersection points of an imaginary line segment passing through a center of a horizontal cross section of the hollow block and an outer perimeter of the horizontal cross section to a distance D1 between intersection points of an imaginary line segment passing through a center of a horizontal cross section of the hollow block and an inner perimeter of the horizontal cross section is from 0.32 to 0.98.

2. The method of claim 1, further comprising, after the filling, forming a concrete foundation by casting unhardened concrete over the hollow blocks filled with the filler and curing the concrete.

3. The method of claim 2, further comprising, before the forming of the concrete foundation, covering an upper part of the hollow blocks to prevent moisture of the unhardened concrete from entering the hollow parts of the hollow blocks.

4. The method of claim 1, wherein the leveling comprises: spreading and compacting a base material to flat an upper surface of the base material, the base material comprising at least one of gravel and sandy soil.

5. The method of claim 4, wherein the base material is formed to a depth greater than ½ of a length of a longest possible line segment connecting two points on an outer perimeter of a horizontal cross section of the hollow block.

6. The method of claim 1, wherein the hollow block is formed such that a cross section formed by the sidewall is shaped as a circle.

7. The method of claim 1, wherein, in the arranging, the plurality of the hollow blocks are arranged in a mesh form with a particular distance in-between, the distance being smaller than or equal to a thickness of the sidewall.

8. The method of claim 1, wherein, in the arranging, the plurality of the hollow blocks being in contact with one another are arranged such that outer perimeters of the sidewalls touch one another to form no space among the plurality of hollow blocks.

9. The method of claim 1, wherein the plurality of hollow blocks are integrated as a unit block set.

10. The method of claim 8, wherein the hollow block is formed such that a cross section formed by the sidewall is shaped as a regular hexagon, and the plurality of hollow blocks share the sidewall to be integrated as a unit block set having a honeycomb shape.

11. The method of claim 1, wherein a proportion of the distance D2 between intersection points between an imaginary line segment passing through a center of a horizontal cross section of the hollow block and an outer perimeter of the horizontal cross section to a height H of the hollow block is from 0.15 to 1.1.

12. The method of claim 1, further comprising, after the filling with the filler:

spreading and compacting a base material to flat an upper surface of the base material over the hollow blocks filled with the filler, the base material comprising at least one of gravel and sandy soil;

arranging other hollow blocks adjacent to one another in a mesh form over the flattened base material; and filling the hollow parts and spaces formed by the hollow blocks with a filler, the filler comprising at least one of gravel and sandy soil.

13. The method of claim 1, wherein the filling the hollow part with the filler comprises filling the hollow part with the filler such that said the other side of the hollow block has a flat surface.

* * * * *